US011098893B2

(12) United States Patent
Hirata et al.

(10) Patent No.: US 11,098,893 B2
(45) Date of Patent: Aug. 24, 2021

(54) NOZZLE STRUCTURE FOR HYDROGEN GAS BURNER APPARATUS

(71) Applicant: TOYOTA JIDOSHA KABUSHIKI KAISHA, Toyota (JP)

(72) Inventors: Koichi Hirata, Nisshin (JP); Daisuke Sakuma, Nagoya (JP); Noriyuki Ueno, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 60 days.

(21) Appl. No.: 16/101,694

(22) Filed: Aug. 13, 2018

(65) Prior Publication Data

US 2019/0072273 A1 Mar. 7, 2019

(30) Foreign Application Priority Data

Sep. 5, 2017 (JP) ..... JP2017-169965

(51) Int. Cl.
*F23D 14/20* (2006.01)
*F23D 14/12* (2006.01)
(Continued)

(52) U.S. Cl.
CPC ..... *F23D 14/20* (2013.01); *F23D 14/12* (2013.01); *F23D 14/22* (2013.01); *F23C 13/00* (2013.01);
(Continued)

(58) Field of Classification Search
CPC ..... F23D 14/20; F23D 14/12; F23D 14/222; F23C 13/00; F23C 2203/002
(Continued)

(56) References Cited

U.S. PATENT DOCUMENTS 5,129,333 A * 7/1992 Frederick ..... F23D 17/00 110/235
5,609,781 A * 3/1997 Kaga ..... B23K 26/032 219/121.67
(Continued)

FOREIGN PATENT DOCUMENTS

JP 53-9531 U 1/1978
JP 2003-279001 A1 10/2003
(Continued)

OTHER PUBLICATIONS

Machine Translation of Communication issued Dec. 1, 2020 by the Japanese Patent Office in application No. 2017-169965.

*Primary Examiner* — David J Laux
*Assistant Examiner* — Nikhil P Mashruwala
(74) *Attorney, Agent, or Firm* — Sughrue Mion, PLLC

(57) ABSTRACT

The present disclosure provides a nozzle structure for a hydrogen gas burner apparatus capable of reducing an amount of generated NOx. A nozzle structure for a hydrogen gas burner apparatus includes an outer tube and an inner tube concentrically disposed inside the outer tube. The inner tube is disposed so that an oxygen-containing gas is discharged from an opened end of the inner tube in an axial direction of the inner tube. The outer tube extends beyond the opened end of the inner tube in the axial direction of the inner tube so that a hydrogen gas passes through a space between an inner circumferential surface of the outer tube and an outer circumferential surface of the inner tube.

4 Claims, 8 Drawing Sheets

(51) Int. Cl.
*F23D 14/22* (2006.01)
*F23C 13/00* (2006.01)

(52) U.S. Cl.
CPC ..... *F23C 2900/9901* (2013.01); *F23D 2203/002* (2013.01)

(58) Field of Classification Search
USPC ..... 431/353
See application file for complete search history.

(56) References Cited

U.S. PATENT DOCUMENTS 5,692,891 A * 12/1997 Chow ..... F23D 14/58 431/354
5,997,595 A * 12/1999 Yokohama ..... C10J 3/487 239/399
6,113,389 A * 9/2000 Joshi ..... C03B 5/2353 431/11
6,142,764 A * 11/2000 Anderson ..... F23D 14/32 431/8
6,682,339 B2 * 1/2004 Cho ..... F23D 14/22 431/187
7,588,074 B1 * 9/2009 White ..... E04H 7/30 165/166
7,959,708 B2 * 6/2011 Mahoney ..... F23D 14/22 75/528
8,066,509 B2 * 11/2011 Eroglu ..... F23C 7/002 431/10
8,328,885 B2 * 12/2012 Lee ..... C01B 3/34 422/625
9,017,067 B2 * 4/2015 Cao ..... F23D 14/32 110/204
10,041,666 B2 * 8/2018 Luka ..... F23D 14/78
10,337,732 B2 * 7/2019 Faulkinbury ..... F23D 14/78
10,627,107 B2 * 4/2020 Hirata ..... F23D 14/02
10,648,662 B2 * 5/2020 Maitani ..... F23D 14/12
2007/0092847 A1 * 4/2007 Okazaki ..... F23D 1/00 431/187
2009/0220899 A1 * 9/2009 Spangelo ..... F23D 14/22 431/8
2010/0159410 A1 * 6/2010 Hwang ..... F23D 14/02 431/354
2011/0027739 A1 2/2011 Colin et al.
2012/0181355 A1 7/2012 Corry et al.
2013/0032250 A1 * 2/2013 Sato ..... F23D 14/22 148/194
2013/0291772 A1 * 11/2013 Mine ..... F23J 15/02 110/347
2015/0068438 A1 3/2015 Taniguchi et al.
2015/0176840 A1 * 6/2015 Tamura ..... F23K 3/02 110/265
2016/0107914 A1 4/2016 Baker et al.
2018/0058688 A1 * 3/2018 Faulkinbury ..... C03B 5/1675
2018/0156451 A1 * 6/2018 Hirata ..... F23C 6/045

FOREIGN PATENT DOCUMENTS

JP 2005-188775 A 7/2005
JP 2007-10173 A 1/2007
JP 4910129 B2 4/2012
JP 2013-194993 A 9/2013
JP 5331713 B2 10/2013
JP 2019045083 A * 3/2019 ..... F23D 14/24
WO 2013024783 A1 2/2013
WO 2014193390 A1 12/2014

* cited by examiner

NOZZLE STRUCTURE FOR HYDROGEN GAS BURNER APPARATUS

CROSS REFERENCE TO RELATED APPLICATIONS

This application is based upon and claims the benefit of priority from Japanese patent application No. 2017-169965, filed on Sep. 5, 2017, the disclosure of which is incorporated herein in its entirety by reference.

BACKGROUND

The present disclosure relates to a nozzle structure for a hydrogen gas burner apparatus.

Japanese Unexamined Patent Application Publication No. 2005-188775 discloses a nozzle structure for a burner in which a combustion gas such as a hydrocarbon gas is premixed with air, so that generation of NOx is suppressed.

SUMMARY

The present inventors have found the following problem. That is, there are cases where a hydrogen gas is used as a fuel gas. In such a case, since the hydrogen gas is highly reactive compared to a hydrocarbon gas, a temperature of a combustion flame could locally become high. As a result, a large amount of NOx is sometimes generated.

The present disclosure has been made to reduce an amount of generated NOx.

A first exemplary aspect is a nozzle structure for a hydrogen gas burner apparatus, including an outer tube and an inner tube concentrically disposed inside the outer tube, in which the inner tube is disposed so that an oxygen-containing gas is discharged from an opened end of the inner tube in an axial direction (e.g., a direction along an axis Y1, a direction roughly parallel to the axis Y1, or the like), and the outer tube extends beyond the opened end of the inner tube in the axial direction so that a hydrogen gas passes through a space between an inner circumferential surface of the outer tube and an outer circumferential surface of the inner tube.

According to the above-described configuration, after being discharged from the opened end of the inner tube in the axial direction, the oxygen-containing gas proceeds along an inner side of a part of the outer tube that extends beyond the opened end of the inner tube in the axial direction. Meanwhile, after passing through the space between the inner circumferential surface of the outer tube and the outer circumferential surface of the inner tube, the hydrogen gas proceeds along an outer periphery of the oxygen-containing gas. In this way, contact between the oxygen-containing gas and the hydrogen gas is suppressed, thus making it possible to suppress mixture of the oxygen-containing gas and the hydrogen gas. Therefore, it is possible to prevent a temperature of a combustion flame from locally becoming high and thereby to reduce the amount of generated NOx.

Further, the nozzle structure may further include:

an oxygen-containing gas blowing duct configured to blow out the oxygen-containing gas in the axial direction and make the oxygen-containing gas pass through a space inside the inner tube; and a hydrogen gas blowing duct configured to blow out the hydrogen gas into the space between the inner circumferential surface of the outer tube and the outer circumferential surface of the inner tube in the axial direction, and make the hydrogen gas pass through between the inner circumferential surface of the outer tube and the outer circumferential surface of the inner tube, in which the oxygen-containing gas blowing duct may have a circular shape, and the hydrogen gas blowing duct may have an annular shape so as to surround the oxygen-containing gas blowing duct.

According to the above-described configuration, since the hydrogen gas and the oxygen-containing gas are further propelled along the axial direction, the progress of the mixture of the hydrogen gas and the oxygen-containing gas is further suppressed. Therefore, it is possible to further prevent the temperature of the combustion flame from locally becoming high and thereby to further reduce the amount of generated NOx.

Further, in a section between the opened end of the inner tube and a base part thereof, a fin that extends in the axial direction while protruding toward the inner tube may be provided on the inner circumferential surface of the outer tube, or a fin that extends in the axial direction while protruding toward the outer tube may be provided on the outer circumferential surface of the inner tube.

According to the above-described configuration, since the hydrogen gas and the oxygen-containing gas are further propelled along the axial direction, the progress of the mixture of the hydrogen gas and the oxygen-containing gas is further suppressed. Therefore, it is possible to further prevent the temperature of the combustion flame from locally becoming high and thereby to further reduce the amount of generated NOx.

The present disclosure can reduce the amount of generated NOx.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied are explained hereinafter in detail with reference to the drawings. However, the present disclosure is not limited to embodiments shown below. Further, the following descriptions and the drawings are simplified as appropriate for clarifying the explanation. A right-handed three-dimensional xyz-coordinate system is defined in FIGS. 1-4 and 7-10.

First Embodiment

A first embodiment is described with reference to FIGS. 1 to 3.

Figure 1:
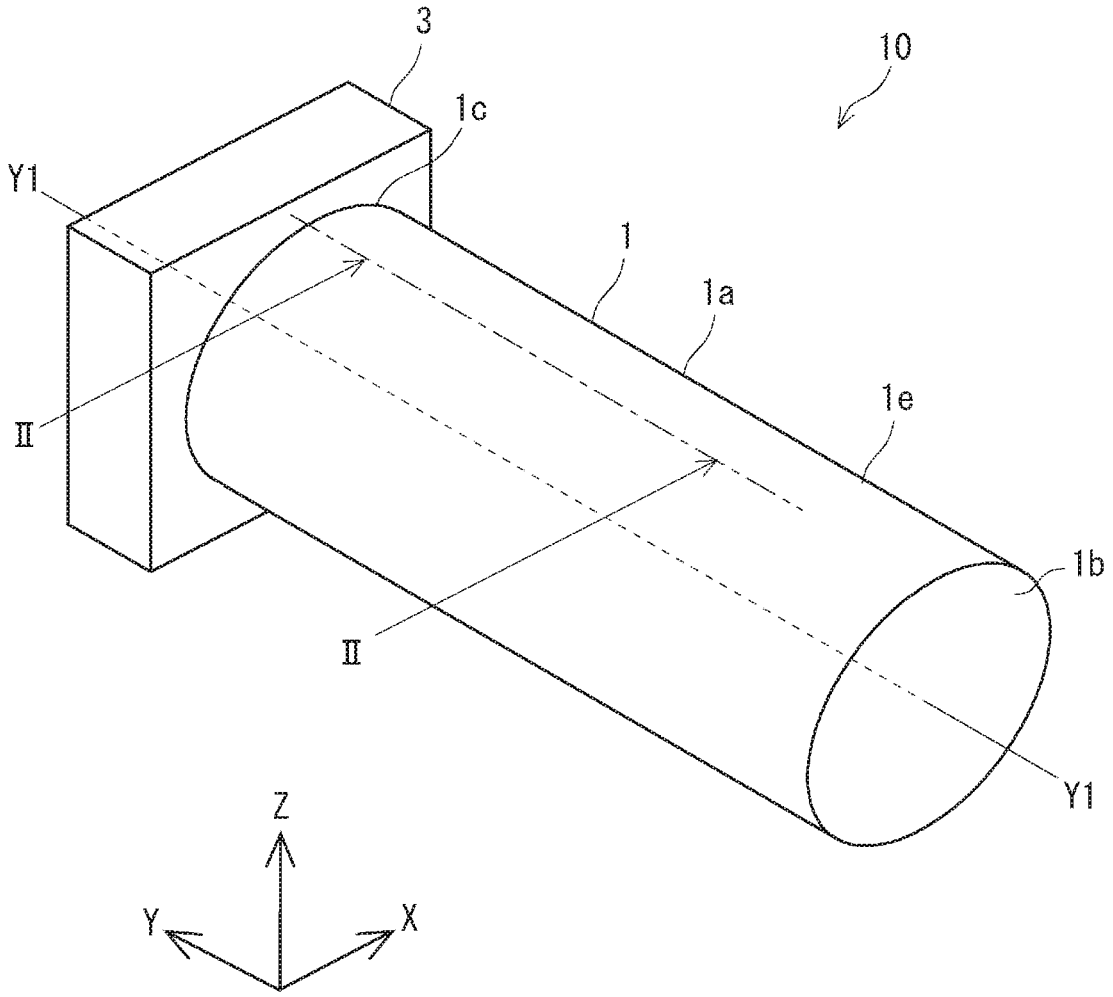
FIG. 1 is a perspective view of a nozzle structure for a hydrogen gas burner apparatus according to a first embodiment.
Figure 2:
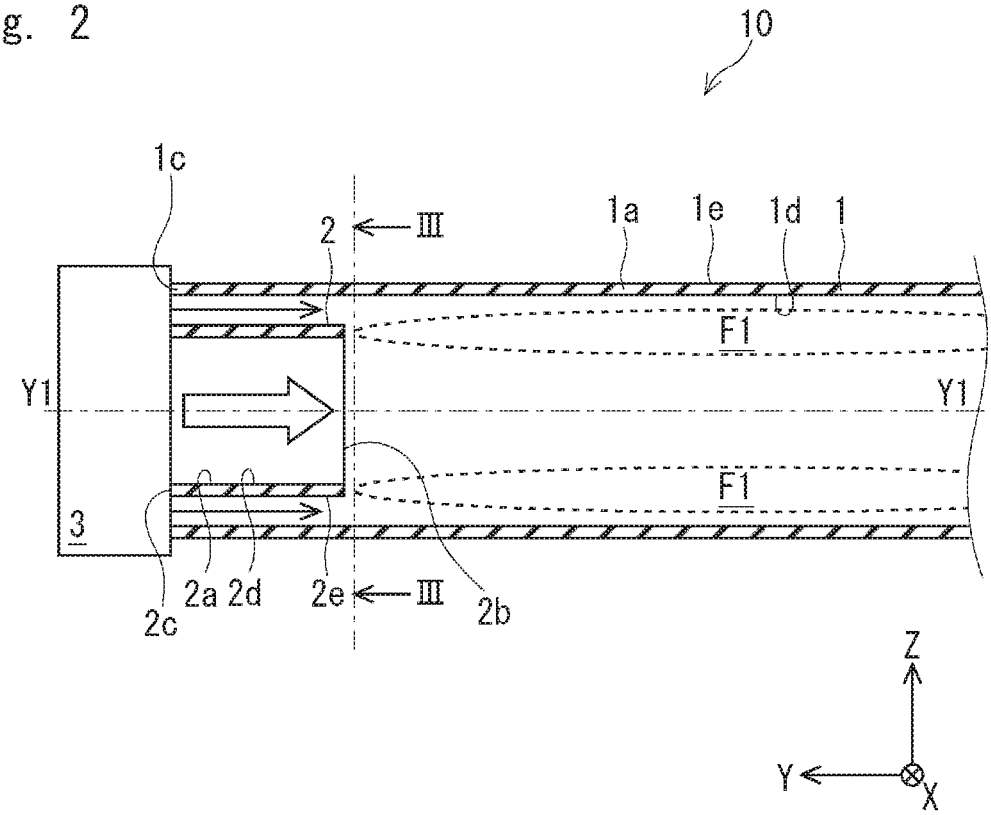
FIG. 2 is a cross section of the nozzle structure for the hydrogen gas burner apparatus according to the first embodiment.

As shown in FIGS. 1 and 2, a nozzle structure 10 for a hydrogen gas burner apparatus includes an outer tube 1, an inner tube 2, and a gas blowing part 3. The nozzle structure 10 is used as a nozzle disposed in a hydrogen gas burner apparatus.

The outer tube 1 includes a cylindrical part 1*a* having an axis Y1. The cylindrical part 1*a* includes an outer circumferential surface 1*e*. Specifically, the cylindrical part 1*a* is attached to the gas blowing part 3 and extends from the gas blowing part 3 roughly in a straight line along the axis Y1. The outer tube 1 is made of a material that receives heat from the inside thereof and radiates radiant heat to the outside. The outer tube 1 is, for example, a radiant tube.

While one end part 1*b* of the outer tube 1 in the example shown in FIGS. 1 and 2 is opened, the other end part 1*c* is closed. Although the example of the cylindrical part 1*a* shown in FIG. 1 is a cylindrical body extending roughly in a straight line along the axis Y1, the shape of the cylindrical part is not limited to this example. That is, the cylindrical part may further include a cylindrical part that extends along a curved line. For example, the cylindrical part may further include a cylindrical part that extends along a curved line such as a U-shaped line or an M-shaped line. Further, although the other end part 1*c* is closed by the gas blowing part 3 in the example of the outer tube 1 shown in FIGS. 1 and 2, the other end part 1*c* may include an opening as required for discharging an exhaust gas.

The inner tube 2 is a cylindrical body with an opened end 2*b* and an opened base-side end part 2*c*. The inner tube 2 is attached to the gas blowing part 3 and concentrically disposed inside the outer tube 1. Therefore, the inner tube 2 is a cylindrical body having, like the cylindrical part 1*a* of the outer tube 1, the axis Y1. Since the inner tube 2 is shorter than the outer tube 1, the outer tube 1 extends beyond the opened end 2*b* of the inner tube 2 in a direction along the axis Y1.

Figure 3:
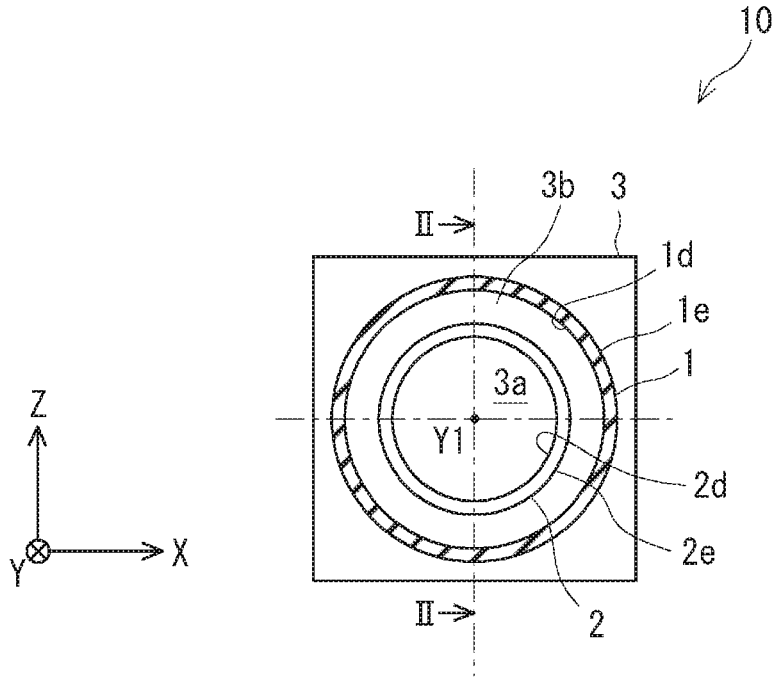
FIG. 3 is a cross section of the nozzle structure for the hydrogen gas burner apparatus according to the first embodiment.

As shown in FIG. 3, the gas blowing part 3 includes an oxygen-containing gas blowing duct 3*a* for blowing out an oxygen-containing gas and a hydrogen gas blowing duct 3*b* for blowing out a hydrogen gas. Examples of gases that can be used as the oxygen-containing gas include air and mixed gases. Examples of the mixed gas include those obtained by mixing an exhaust gas and air, and nitrogen and air. The oxygen-containing gas may be at a room temperature or may be preheated. Note that the oxygen-containing gas is not limited to air and may be any gas containing oxygen. Further, it is preferable that the oxygen-containing gas not substantially contain hydrogen. The oxygen-containing gas may be generated by using a manufacturing method including a process for removing hydrogen using a publicly-known method.

The oxygen-containing gas blowing duct 3*a* has a circular shape. Further, the oxygen-containing gas blowing duct 3*a* blows out an oxygen-containing gas in a direction along the axis Y1 and makes the oxygen-containing gas pass through the space inside the inner tube 2. The inner tube 2 discharges the oxygen-containing gas from its opened end 2*b* in the direction along the axis Y1.

The hydrogen gas blowing duct 3*b* has an annular shape so as to surround the oxygen-containing gas blowing duct 3*a*. The hydrogen gas blowing duct 3*b* blows out a hydrogen gas into a space (i.e., a gap) between an inner circumferential surface 1*d* of the outer tube 1 and an outer circumferential surface 2*e* of the inner tube 2 in a direction roughly parallel to the axis Y1 and makes the hydrogen gas pass through the space between the inner circumferential surface 1*d* of the outer tube 1 and the outer circumferential surface 2*e* of the tube 2. The outer tube 1 and the inner tube 2 discharge the hydrogen gas from the opened end 2*b* of the inner tube 2 in the direction along the axis Y1.

(Heating Method)

Next, a heating method using the nozzle structure 10 for a hydrogen gas burner apparatus is described with reference to FIGS. 1 to 3.

As shown in FIG. 2, while a hydrogen gas is blown out from the hydrogen gas blowing duct 3*b*, an oxygen-containing gas is blown out from the oxygen-containing gas blowing duct 3*a*. As a result, the hydrogen gas and the oxygen-containing gas are discharged from the opened end 2*b* of the inner tube 2 in a direction roughly parallel to the axis Y1. After being discharged from the opened end 2*b* of the inner tube 2 in the direction along the axis Y1, the oxygen-containing gas proceeds inside of the part of the outer tube 1 that extends beyond the opened end 2*b* toward the one end 1*b* of the outer tube 1. Meanwhile, after passing through the space between the inner circumferential surface 1*d* of the outer tube 1 and the outer circumferential surface 2*e* of the inner tube 2, the hydrogen gas proceeds along the outer periphery of the oxygen-containing gas. In this way, contact between the oxygen-containing gas and the hydrogen gas is prevented, thus making it possible to suppress the mixture of the oxygen-containing gas and the hydrogen gas.

Next, by using an ignition apparatus such as a spark plug (not shown), a spark is made and the hydrogen gas is ignited and burned. As a result, a tubular flame F1 is generated. The tubular flame F1 extends from the opened end 2*b* of the inner tube 2 toward the one end 1*b* of the outer tube 1 and converges. The tubular flame F1 heats the outer tube 1, and the outer tube 1 generates radiant heat and thereby generates heat.

Figure 4:
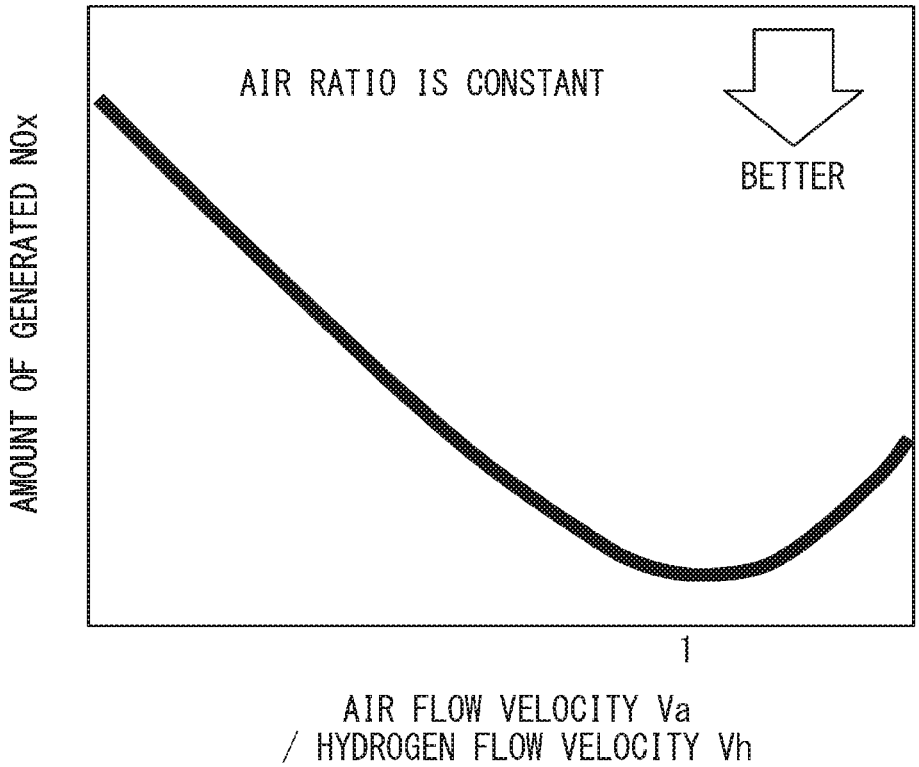
FIG. 4 is a graph showing amounts of generated NOx versus ratios Va/Vh of air flow velocities Va and hydrogen flow velocities Vh.
Figure 5:
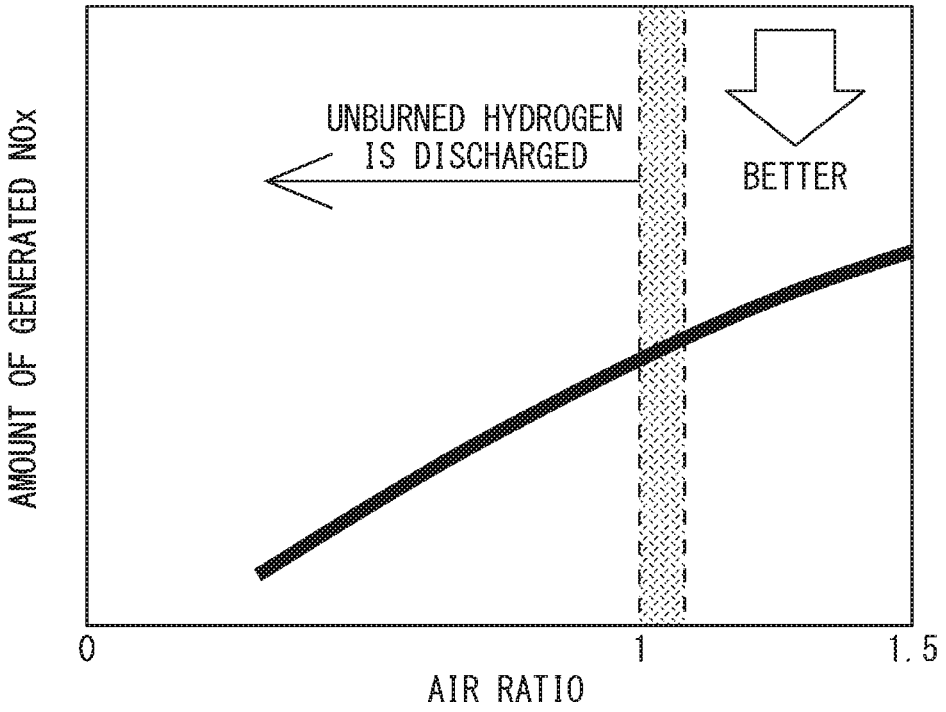
FIG. 5 is a graph showing amounts of generated NOx versus air ratios.
Figure 6:
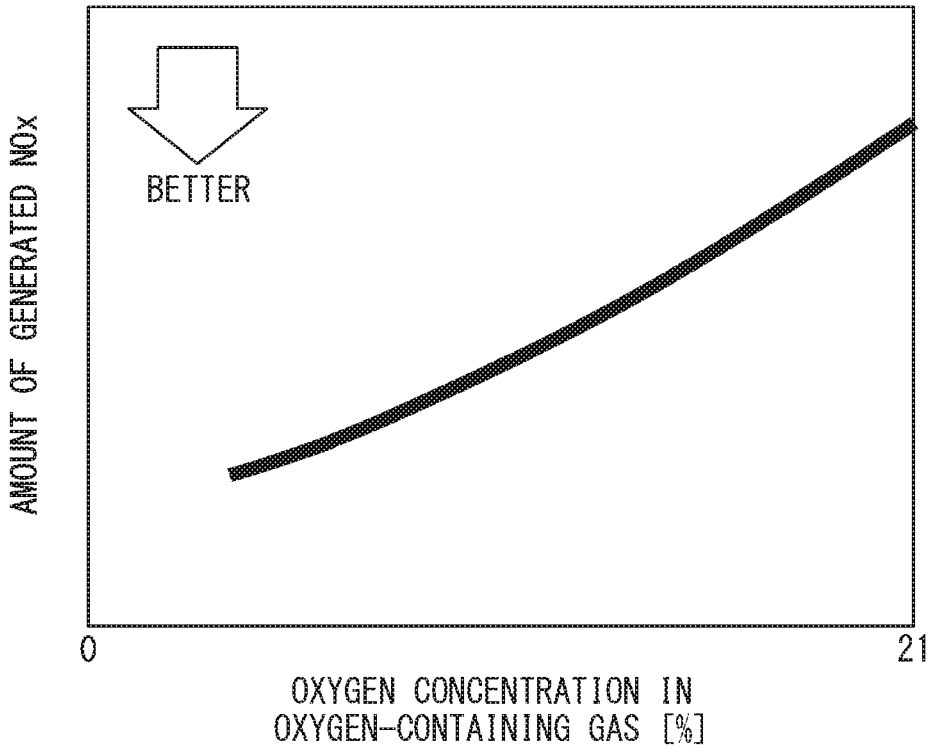
FIG. 6 is a graph showing amounts of generated NOx versus concentration of oxygens of an oxygen-containing gas.

The condition for the combustion in the heating method using the nozzle structure 10 for the hydrogen gas burner apparatus is explained hereinafter. Amounts of generated NOx were measured under various conditions by using an example of the heat generation method using the nozzle structure 10 for the hydrogen gas burner apparatus. FIGS. 4 to 6 show results of these measurements.

As shown in FIG. 4, when a ratio Va/Vh between an air flow velocity Va and a hydrogen flow velocity Vh is equal to or close to 1.0, the amount of generated NOx is the lowest.

Therefore, the ratio Va/Vh is preferably equal to or close to 1.0. For example, the ratio Va/Vh is preferably in a range of no lower than 0.1 and no higher than 3.0. The air flow velocity Va and the hydrogen flow velocity Vh can be changed by changing the inner diameter of the inner tube 2 and the thickness of the inner tube 2, respectively.

Further, as shown in FIG. 5, when the air ratio is increased, the amount of generated NOx tends to increase. The air ratio is preferably in a range of no lower than 1.0 and no higher than 1.5. The air ratio is preferably 1.0 or higher because, based on calculation, when the air ratio is 1.0 or higher, no unburned hydrogen is discharged. Further, the air ratio is preferably 1.5 or lower because when the air ratio is 1.5 or lower, the combustion does not require a larger amount of air, thus contributing to energy-saving.

Further, as shown in FIG. 6, when the concentration of oxygen in the oxygen-containing gas is increased, the amount of generated NOx tends to increase. It is preferable that the concentration of oxygen in the oxygen-containing gas be, for example, no lower than 10 vl % and no higher than 21 vl %. The concentration of oxygen in the oxygen-containing gas is preferably 10% or higher because when the connection is 10% or higher, a combustion flame can be stably generated. The concentration of oxygen in the oxygen-containing gas is preferably lower than 21% because when the concentration is lower than 21%, it is lower than the concentration of oxygen in the air, thus making it possible to reduce the amount of generated NOx.

As described above, after the oxygen-containing gas is discharged from the opened end 2*b* of the inner tube 2 in the direction along the axis Y1, it proceeds inside of the part of the outer tube 1 that extends beyond the opened end 2*b* of the inner tube 2 in the direction along the axis Y1. Meanwhile, after the hydrogen gas passes through the space between the inner circumferential surface 1*d* of the outer tube 1 and the outer circumferential surface 2*e* of the inner tube 2, it proceeds along the outer periphery of the oxygen-containing gas. In this way, contact between the oxygen-containing gas and the hydrogen gas is suppressed and hence the hydrogen gas is slowly burned. Therefore, it is possible to prevent the temperature of the tubular flame F1 from locally becoming high and thereby to reduce the amount of generated NOx. Further, a flashback phenomenon hardly occurs.

Further, the nozzle structure 10 includes the gas blowing part 3, and the gas blowing part 3 includes the oxygen-containing gas blowing duct 3*a* having a circular shape and the hydrogen gas blowing duct 3*b* having an annular shape. Since the oxygen-containing gas blowing duct 3*a* enables the oxygen-containing gas to be uniformly blown out therefrom in the direction along the axis Y1, a flow of the oxygen-containing gas having a circular cross section is formed. Further, since the hydrogen gas blowing duct 3*b* enables the hydrogen gas to be uniformly blown out therefrom in the direction roughly parallel to the axis Y1, a flow of the hydrogen gas having an annular cross section is formed. Therefore, the hydrogen gas having the annular cross section flows around the outer periphery of the oxygen-containing gas having the circular cross section. Consequently, the mixture of the hydrogen gas and the oxygen-containing gas is further prevented from advancing. Accordingly, it is possible to further prevent the temperature of the tubular flame F1 from locally becoming high and thereby to further reduce the amount of generated NOx.

Modified Example of First Embodiment

Next, a modified example of the nozzle structure according to the first embodiment is described with reference to FIGS. 7 and 8.

Figure 7:
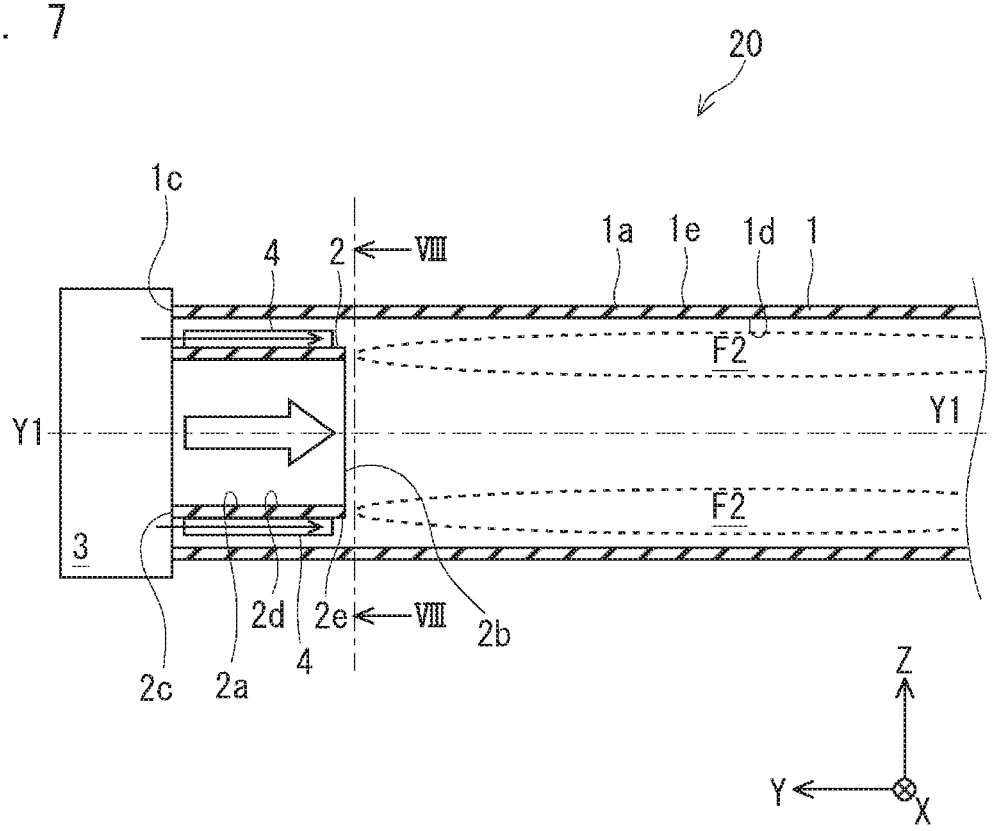
FIG. 7 is a cross section of a modified example of the nozzle structure for the hydrogen gas burner apparatus according to the first embodiment.
Figure 8:
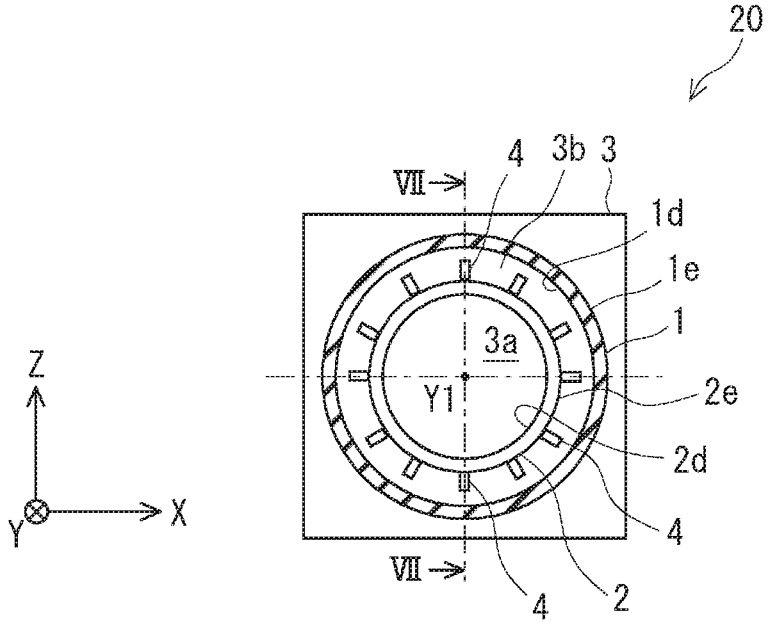
FIG. 8 is a cross section of a modified example of the nozzle structure for the hydrogen gas burner apparatus according to the first embodiment.

As shown in FIGS. 7 and 8, a nozzle structure 20 has a configuration similar to that of the nozzle structure 10 (see FIGS. 1 to 3), except that the nozzle structure 20 includes fins 4. The fins 4 are disposed on the outer circumferential surface 2*e* of the inner tube 2. As shown in FIG. 7, in a section between the opened end 2*b* of the inner tube 2 and the base-side end part 2*c* thereof, the fins 4 extend along the axis Y1 of the outer tube 1 while protruding toward the outer tube 1. As shown in FIG. 8, a plurality of fins 4 are provided on the outer circumferential surface 2*e* of the inner tube 2 and are disposed in such a manner that they perpendicularly protrude from the outer circumferential surface 2*e* in a radial pattern around the axis Y1. In the example of the fins 4 shown in FIG. 8, twelve fins are provided on the outer circumferential surface 2*e* of the inner tube 2. In the example of the fins 4 shown in FIG. 8, they are arranged around the axis Y1 at angular intervals that are obtained by dividing 360° by twelve, i.e., arranged at intervals of 30°.

Note that the nozzle structure 20 comprises the fins 4, and the fins 4 guide the hydrogen gas blown out from the hydrogen gas blowing duct 3*b* so that the hydrogen gas is further propelled in a direction roughly parallel to the axis Y1 toward the one end part 1*b* of the outer tube 1. Further, the fins 4 prevent the hydrogen gas from flowing in such a manner that it is rotated around the axis Y1. Therefore, the mixture of the hydrogen gas and the oxygen-containing gas is further prevented from advancing. Consequently, it is possible to further prevent the temperature of the tubular flame F1 from locally becoming high and thereby to further reduce the amount of generated NOx.

Another Modified Example of First Embodiment

Next, another modified example of the nozzle structure according to the first embodiment is described with reference to FIGS. 9 and 10.

Figure 9:
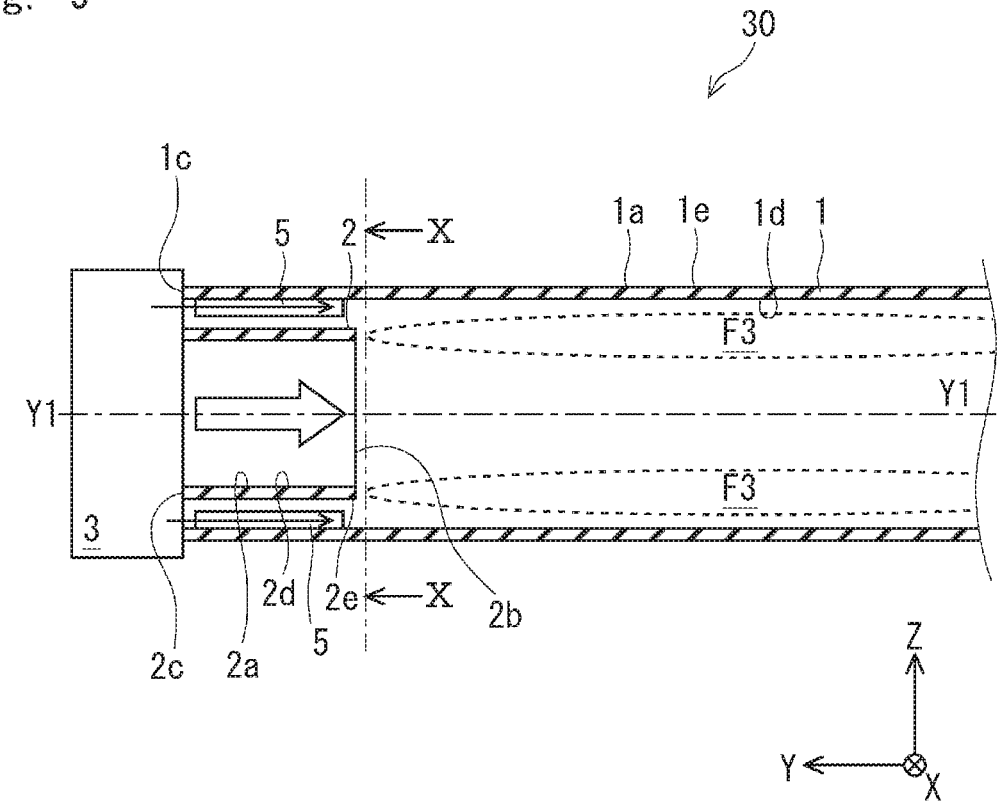
FIG. 9 is a cross section of another modified example of the nozzle structure for the hydrogen gas burner apparatus according to the first embodiment.
Figure 10:
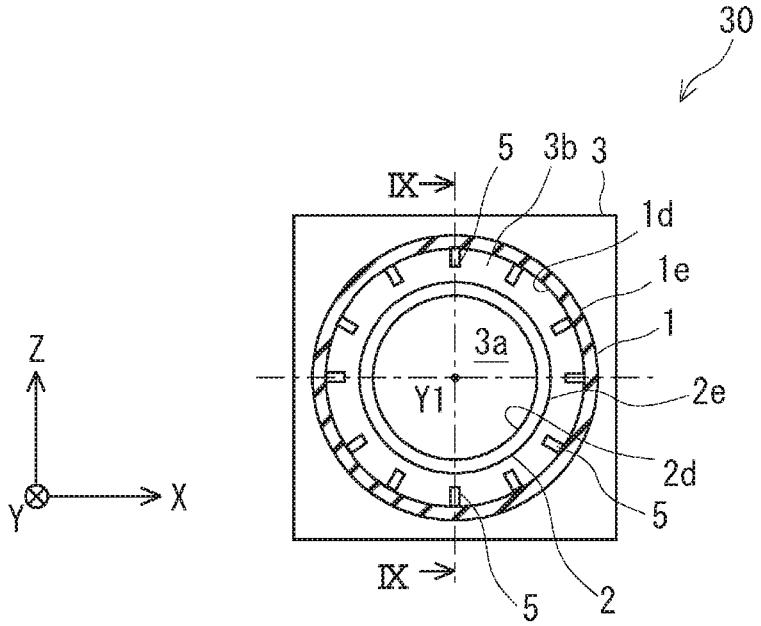
FIG. 10 is a cross section of another modified example of the nozzle structure for the hydrogen gas burner apparatus according to the first embodiment.

As shown in FIGS. 9 and 10, a nozzle structure 30 has a configuration similar to that of the nozzle structure 10 (see FIGS. 1 to 3), except that the nozzle structure 30 includes fins 5. The fins 5 are disposed on the surface of the outer tube 1 that faces the inner tube 2, i.e., disposed on the inner circumferential surface 1*d* of the outer tube 1. As shown in FIG. 9, in a section between the opened end 2*b* of the inner tube 2 and the base-side end part 2*c* thereof, the fins 5 extend in a direction roughly parallel to the axis Y1 of the outer tube 1 while protruding toward the inner tube 2. A plurality of fins 5 are provided on the inner circumferential surface 1*d* of the outer tube 1 and are disposed in such a manner that they perpendicularly protrude from the inner circumferential surface 1*d* in a radial pattern around the axis Y1. In the example of the fins 5 shown in FIGS. 9 and 10, twelve fins are provided on the inner circumferential surface 1*d* of the outer tube 1. In the example of the fins 5 shown in FIG. 9, they are arranged around the axis Y1 at angular intervals that are obtained by dividing 360° by twelve, i.e., arranged at intervals of 30°.

Note that the nozzle structure 30 comprises the fins 5, and the fins 5 guide the hydrogen gas blown out from the hydrogen gas blowing duct 3*b* so that the hydrogen gas is further propelled in a direction roughly parallel to the axis Y1 toward the one end part 1*b* of the outer tube 1. Further, the fins 5 prevent the hydrogen gas from flowing in such a manner that it is rotated around the axis Y1. Therefore, the progress of the mixture of the hydrogen gas and the oxygen-containing gas is further suppressed. Consequently, it is possible to further prevent the temperature of the tubular flame F1 from locally becoming high and thereby to further reduce the amount of generated NOx.

EXAMPLE

Next, a combustion experiment was carried out by using an example of the nozzle structure 10 (see FIGS. 1 to 3), and results of measurement in which amounts of generated NOx were measured for different combustion load factors are explained.

Note that in a comparative example 1, a combustion experiment was carried out by using a publicly-known nozzle structure having a configuration different from that of the nozzle structure 10 and by using a hydrocarbon gas as a fuel gas. This known nozzle structure is commonly used in cases where a hydrocarbon gas is used as a fuel gas. In a comparative example 2, a combustion experiment was carried out by using a publicly-known nozzle structure having a configuration different from that of the nozzle structure 10 and by using a hydrogen gas as a fuel gas. In each of the comparative examples 1 and 2, amounts of generated NOx were measured for different combustion load factors.

Figure 11:
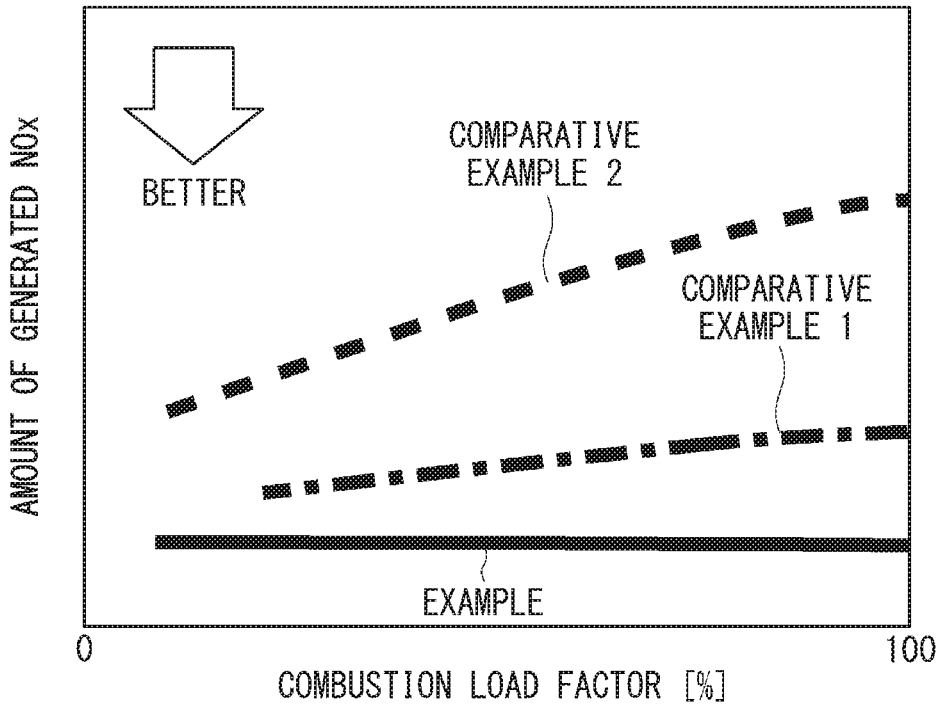
FIG. 11 is a graph showing amounts of generated NOx versus combustion load factors.

As shown in FIG. 11, in the example, the amount of generated NOx tends to be constant even when the combustion load factor is increased. In contrast to this, in the comparative examples 1 and 2, the amount of generated NOx tends to increase when the combustion load factor is increased. The amounts of generated NOx in both of the comparative examples 1 and 2 were higher than the amount of generated NOx in the example irrespective of the combustion load factor. In other words, the amount of generated NOx in the example was lower than those in the comparative examples 1 and 2.

Note that the present disclosure is not limited to the above-described embodiments and they can be modified as desired without departing from the spirit of the present disclosure. For example, although the nozzle structures 20 and 30 (see FIGS. 7 to 10) are equipped with the fins 4 and 5, respectively, they may be equipped with either of the fins 4 and 5.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A nozzle structure for a hydrogen gas burner apparatus, comprising an outer tube and an inner tube concentrically disposed inside the outer tube, wherein the inner tube is disposed so that an oxygen-containing gas is discharged from an opened end of the inner tube in an axial direction, and the outer tube extends beyond the opened end of the inner tube in the axial direction so that a hydrogen gas passes through a space between an inner circumferential surface of the outer tube and an outer circumferential surface of the inner tube and proceeds along an outer periphery of the oxygen-containing gas, thereby suppressing contact between and mixture of the oxygen-containing gas and the hydrogen gas, wherein the outer tube forms the exterior surface of the nozzle structure, wherein a fin is provided in a section between the opened end of the inner tube and a base part thereof, wherein the fin has a rectangular planar shape and a long side of the rectangular planar shape extends in the axial direction, and wherein the fin is configured to guide the hydrogen gas in a direction parallel to the axial direction.

2. The nozzle structure for a hydrogen gas burner apparatus according to claim 1, further comprising:

an oxygen-containing gas blowing duct configured to blow out the oxygen-containing gas in the axial direction and make the oxygen-containing gas pass through a space inside the inner tube; and a hydrogen gas blowing duct configured to blow out the hydrogen gas into the space between the inner circumferential surface of the outer tube and the outer circumferential surface of the inner tube in the axial direction, and make the hydrogen gas pass through between the inner circumferential surface of the outer tube and the outer circumferential surface of the inner tube, wherein the oxygen-containing gas blowing duct has a circular shape, and the hydrogen gas blowing duct has an annular shape so as to surround the oxygen-containing gas blowing duct.

3. The nozzle structure for a hydrogen gas burner apparatus according to claim 1, wherein the fin protrudes toward the inner tube and is provided on the inner circumferential surface of the outer tube.

4. The nozzle structure for a hydrogen gas burner apparatus according to claim 1, wherein the fin protrudes toward the outer tube and is provided on the outer circumferential surface of the inner tube.

* * * * *